US006370921B1

(12) United States Patent
Winowich, Jr. et al.

(10) Patent No.: US 6,370,921 B1
(45) Date of Patent: Apr. 16, 2002

(54) TUBULAR KNITTING MACHINE

(75) Inventors: Derrell M. Winowich, Jr.; Colin J. Hallam, both of Phenix City; Louis Kevin Horne, Smiths, all of AL (US)

(73) Assignee: V2 Composite Reinforcements, Inc., Auburn, AL (US)

( * ) Notice: Subject to any disclaimer, the term of this patent is extended or adjusted under 35 U.S.C. 154(b) by 0 days.

(21) Appl. No.: 09/837,633

(22) Filed: Apr. 18, 2001

(51) Int. Cl.[7] ..... D04B 9/16
(52) U.S. Cl. ..... 66/10; 66/9 R
(58) Field of Search ..... 66/9 R, 10, 9 B, 66/11, 12, 9 A

(56) References Cited

U.S. PATENT DOCUMENTS 3,943,733 A * 3/1976 Wily ..... 66/10
4,015,443 A * 4/1977 Luchi ..... 66/10
4,245,487 A * 1/1981 Schaab et al. ..... 66/10
4,458,506 A * 7/1984 Artzt et al. ..... 66/10
5,431,029 A * 7/1995 Kuhrau et al. ..... 66/10
5,809,804 A * 9/1998 Kuhrau et al. ..... 66/10
6,151,920 A * 11/2000 Schnidler et al. ..... 66/10

* cited by examiner

*Primary Examiner*—Danny Worrell
(74) *Attorney, Agent, or Firm*—Hahn Loeser + Parks LLP; Stephen L. Grant

(57) ABSTRACT

A device knits together a tubular structure of continuous fibers with a stitch yarn, to provide a reinforcing substrate, especially for use with roofing materials. The device brings together first and second sets of the continuous fibers at a cylinder with a plurality of latch needles. The first set of fibers enter the cylinder radially in interstitial spaces between adjacent needles. At least one continuous fiber constituting the second set of fibers enters the cylinder tangentially at an insertion point. Axial manipulation of the needles at the insertion point results in knitting the stitch yarn around the intersecting first and second continuous fibers, resulting in the knitted tubular structure. The manipulation is achieved by rotating the means by which the second fibers and the stitch yarn are introduced, as well as the means for manipulating the needles, in a stepwise sequential manner around the circumference of the cylinder.

9 Claims, 2 Drawing Sheets

TUBULAR KNITTING MACHINE

The present invention relates to a machine for knitting a seamless tubular structure of continuous fibers, but particularly high-performance fibers. Such a tubular structure may be used as a reinforcing substrate for a roofing material by impregnating it with a liquid roofing material, such as a modified bitumen. Other uses may be found for using the tubular structure as a reinforcing substrate for composite pipes, snowboards, water and snow skis, power poles, and many other reinforced structures or parts. In these other uses, the substrate will be effectively embedded into a continuous matrix of a polymeric resin system, such as an epoxy, a polyester, a phenolic material or a vinylester, for example.

BACKGROUND OF THE INVENTION

It is desired to provide a tubular structure of continuous fibers, and particularly high-performance fibers, which may be flattened out to provide a two-ply knitted reinforcement substrate for a roofing material. In addition to direct drawn glass fibers or rovings, other materials which may be used would include carbon fibers, aramid-type fibers including those commercially available from duPont under the KEVLAR trademark. By "rovings" in the above sentence, we mean single end direct draw packages or spools of reinforcement fibers.

It is therefore an advantage of the present invention to provide a tubular knitting machine for preparing a seamless tubular structure of continuous fibers.

SUMMARY OF THE INVENTION

This and other objects of the present invention are provided by the tubular knitting machine and a tubular knitting method.

The device for knitting together a tubular structure of continuous fibers with a stitch yarn comprises a cylinder having a plurality of axially oriented holes equally spaced about a circumference of the cylinder. A plurality of needles, corresponding in number to the plurality of holes, are provided. Each needle has a latch mechanism at one end and a base at the other end. The base end of each needle is inserted into one of the holes. Each pair of adjacent needles defines an interstitial space.

The device further comprises a means for introducing a plurality of a first set of the continuous fibers to the cylinder in an effectively radial manner, with one first continuous fiber corresponding to each said interstitial space between the needles;

The device also comprises a means for introducing at least one second continuous fiber to the cylinder at an insertion point. This at least one second continuous fiber is introduced tangential to the cylinder at the insertion point.

The device also comprises a means for introducing the stitch yam to the latch mechanism of one of the needles on the cylinder adjacent the insertion point for each of the at least one second continuous fiber, as well as a cam section that interacts with the needles near the insertion point to sequentially raise and lower the base ends thereof.

The cam section and the two introducing means are rotated in a stepwise sequential manner relative to the cylinder by a means for rotating, to knit the stitch yarn around the first and second continuous fibers, forming the knitted tubular structure.

In some embodiments, the means for introducing the first continuous fibers includes a ring with a plurality of holes corresponding to the number of the plurality of first continuous fibers. The ring is concentric with the cylinder, although spaced axially away from and radially outward from the cylinder. Each hole directs one of the first continuous fibers from a feed source to one of the interstitial spaces.

In some embodiments, the device further comprises a means for drawing the knitted tubular structure axially away from the cylinder.

In some embodiments, each of the plurality of needles is a compound needle having first and second parts. In such needles, the first part comprises a base at a first end and an open notch at a second end, a channel running axially through a portion of the first part between the base and the notch. The second part comprises a cam follower at a base end thereof and a sheath member with a top end. This sheath member slidingly fits in the channel of the first part so that movement of the cam follower relative to the base causes the second part to slide within the channel, allowing the top end of the sheath member to selectively open or close the opening in the notch.

In some embodiments of the device, the stitch yarn used will be thermally fusible, in which case the device can further comprises a means for heating the knitted tubular structure as it is drawn away from the cylinder to a temperature sufficiently high to fuse the stitch yarn to itself.

The method of forming a knitted tubular structure of continuous fibers is achieved through a number of steps. In one step, a plurality of a first set of the continuous fibers are introduced effectively radial to a cylinder having a plurality plus one of latch needles disposed in incremental spacing about a circumference thereof. These first continuous fibers are introduced so that one of the first continuous fiber passes through an interstitial space defined by a pair of adjacent latch needles. Then, the method introduces at least one second continuous fiber to the cylinder effectively tangentially thereto at an insertion point. A stitch yarn is introduced to a latch mechanism of one of the latch needles on the cylinder adjacent the insertion point for each of the at least one second continuous fiber. By manipulating the latch needles and stitch yarn adjacent to the insertion point, the stitch yarn is knitted about the first and second continuous fibers to form the tubular structure.

In some embodiments, the step of manipulating the latch needles and stitch yarn is achieved by rotating the insertion point for each said at least one second continuous fibers in a stepwise sequential manner around the circumference of the cylinder.

In some embodiments, the method also includes the step of drawing the knitted tubular structure away from the cylinder.

In some embodiments in which the stitch yam is thermally fusible, the method includes the step of heating the knitted tubular structure as it is drawn away from the cylinder to a temperature sufficiently high to fuse the stitch yarn to itself.

BRIEF DESCRIPTION OF THE DRAWINGS

A better understanding of the present invention will be had when reference is made to the accompanying drawings, wherein identical parts are identified by identical reference numerals and wherein.

DETAILED DESCRIPTION OF THE PRESENT INVENTION

Figure 1:
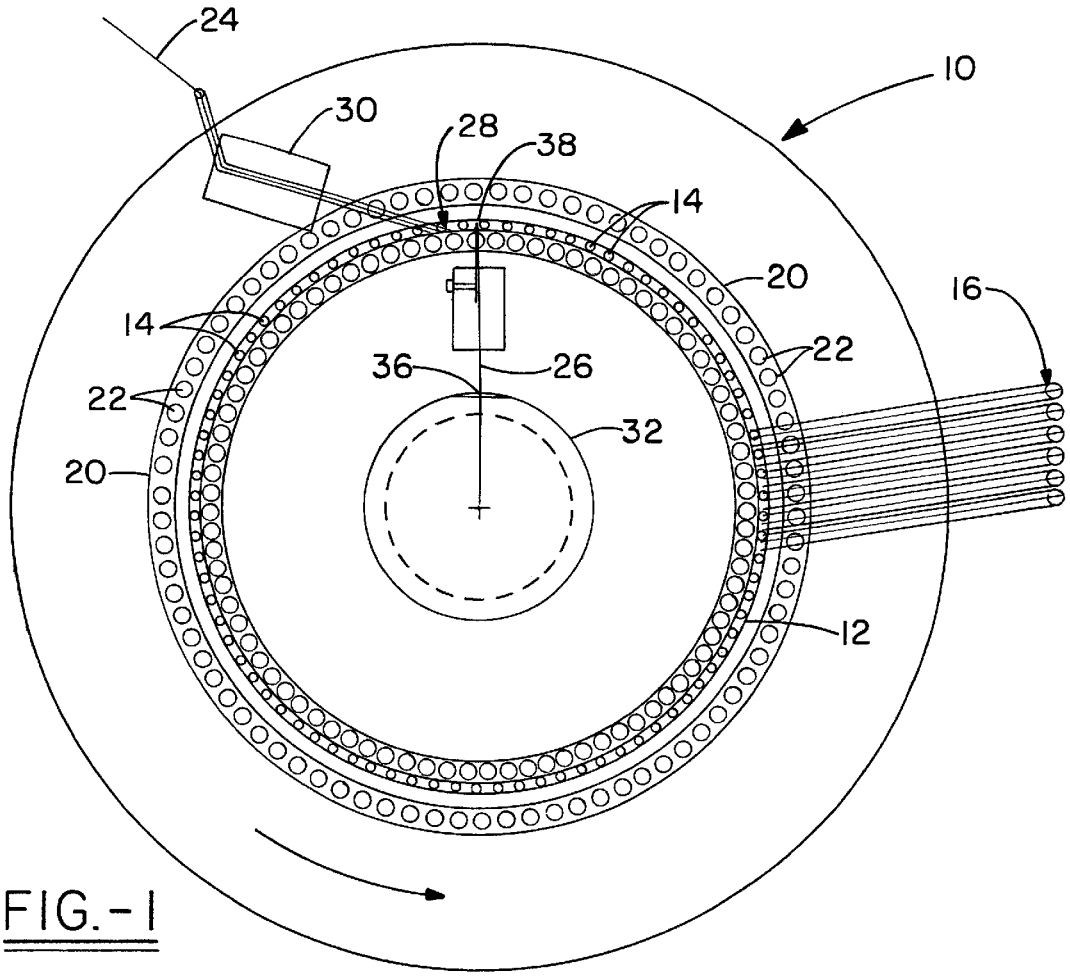
FIG. 1 shows a top plan view of the knitting machine of the present invention.
Figure 4:
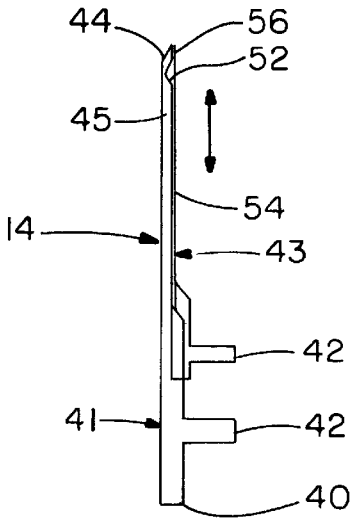
FIG. 4 shows an enlarged side view of the compound piercing needle of the present invention.
Figure 2:
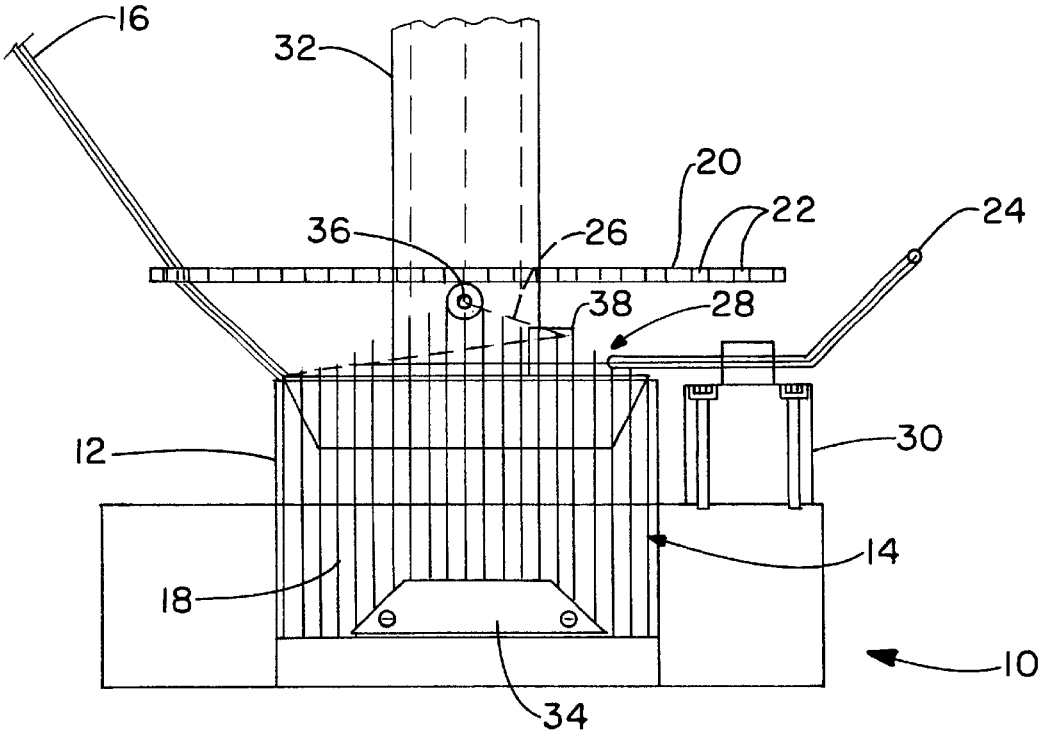
FIG. 2 shows a side elevational view of the machine.

As seen in FIGS. 1 and 2, the knitting device 10 of the present invention comprises a cylinder 12 containing a plurality of needles 14. These needles 14, one of which is shown in FIG. 4 and will be described in more detail below, are positioned so that a longitudinal axis of each needle 14 is effectively parallel to an axis of the cylinder 12. Further, the plurality of needles 14 are equally incrementally spaced about a circumference of the cylinder 12. The needles 14 are preferably seated in slots or holes provided in the cylinder 12. One needle 14 is provided for each of a plurality of a first set of fibers or rovings 16 or can be arranged so as to actually pierce or knit through the roving, which are collectively referred to as the "straight line" or "zero degree" fibers.

The zero degree fibers 16 are fed into the device 10 in a continuous manner from a standing creel (not shown) positioned above and radially outwardly from the cylinder 12. While FIGS. 1 and 2 show only a small number of the zero degree fibers 16 actually being introduced, the complete number of fibers are shown in end view in FIG. 1 as a series of fibers which are radially inward from the needles 14, such that each fiber passes between a pair of needles through an interstitial space or could be set to actually pierce or knit through the individual roving. As will be readily observed, the zero degree fibers 16 run effectively parallel to the needles 14 after introduction to the device 10, although by the time that the fibers 16 are running parallel to the needles 14, the fibers have been effectively converted by the device into a knitted tubular product 18, as will be described. A ring 20, having a plurality of holes 22 spaced incrementally around its circumference, is located above and radially outwardly from the cylinder 12. Each of the holes 22 receives a fiber 16 and assists in guiding the fiber toward the cylinder 12. In this manner, the plurality of first fibers 16 are aligned in incrementally spaced-apart relationship to provide the warp (or longitudinally-running) fibers for the tubular knitted product 18 being formed. For this reason, we refer to fibers 16 as the warp fibers. The preferred material of construction for the ring 20 is stainless steel.

Figure 5:
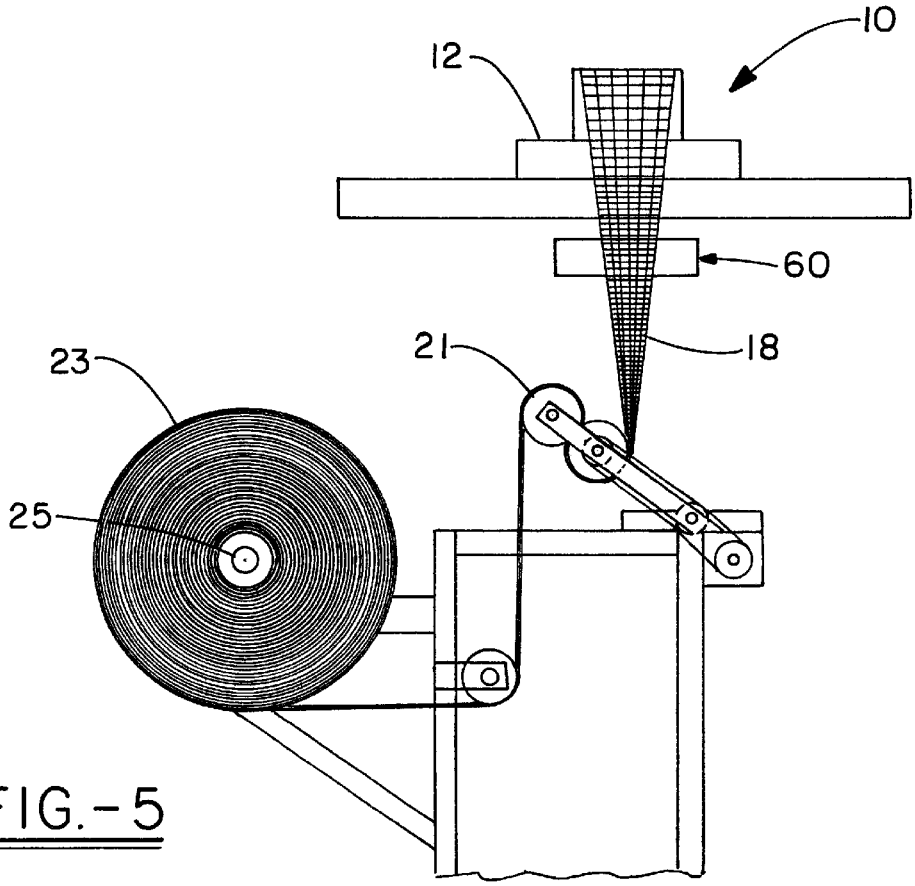
FIG. 5 shows a side elevational view of the product take-up and rolling equipment.

As seen in FIG. 5, a set of pinch rollers 21 is located below the cylinder 12. This set of pinch rollers 21 systematically extracts the tubular knitted product 18 from the device 10 by drawing it off of the cylinder 12 (downwardly in the alignment shown in FIG. 1) at a specified rate set by the production speed of the system. The pinch rollers 21 serve to maintain tension on the zero degree fibers 16 and to set the production rate of the device 10. In FIG. 5, the product 18 is shown as being flattened out into a web and stored as a roll 23 on a core roll 25.

The cylinder 12, the needles 14 contained in the cylinder, and the ring 20 do not rotate as the knitting process proceeds. Therefore, the rotation of other elements which will be described now results in the rotation relative to the cylinder that is essential to the manufacture of the knitted product 18.

At least one second continuous fiber, also referred to as a weft fiber or roving, 24, or known as the ninety degree fiber, is inserted at a top or crown portion of the cylinder, that is, at an elevation identical to that at which the zero degree or warp fibers 16 are inserted past the needles 14. In some cases, the diameter of the cylinder or the material of construction will dictate the use of more than one such weft fiber or roving 24 being introduced, but in such cases, the use of multiple insertions will be understood by the understanding of how a single insertion is accomplished. The point of insertion of the weft fiber 24 is also a point for insertion for a stitch yarn 26. As will now be described, it is this simultaneous introduction of the weft fiber 24 and the stitch yam 26 to the plurality of warp fibers 16 at the insertion point 28 which results in the generation of the tubular knitted product 18. Because the insertion point 28 moves around the knitted product 18 circumferentially as the warp fibers 16 are drawn through the device 10, the weft fiber 24 is effectively knitted into the product in a helical or spiral fashion. While the weft fiber 24 is preferably of the same size and composition as the plurality of warp fibers 14 (depending upon the materials of construction), the stitch yarn is typically a polymeric material and will usually be of a smaller diameter.

Insertion of the weft fiber 24 and the stitch yarn 26 are now described. The weft fiber 24 is introduced through a rotating creel 30, that is, a creel which rotates in synchronization with a shaft 32 which feeds the stitch yarn 26 and a cam section 34 operating below the insertion point 28 to actuate the movements of the needles 14. The rotating creel 30 inserts the weft fiber 24 above the tops of the needles 14 so that the weft fiber is radially and almost tangentially between the needles and the warp fibers 16, the weft fiber ending up radially internal to the needles and radially external the warp fibers. The shaft 32 is typically a hollow tube, preferably of steel, positioned coaxially inside the cylinder 12 and adapted for co-rotation around the cylinder with the cam section 34 and the rotating creel 30. As is best seen in FIG. 2, the stitch yarn 26 passes axially downwardly through the shaft 32 and is then radially outwardly directed through a hole 36 in the shaft and a stitch yarn feeder 38, the latter being positioned slightly inward radially from the warp fibers 16. As best seen in FIG. 1, the stitch yarn 26 passes radially outward as far as the needles 14, into which it is captured, as will be described. In doing this, the stitch yarn 26 passes radially outwardly past the warp fibers 16 at a point above the fibers, so the stitch yarn does not pass through the fibers 16 on its initial pick-up by the needles 14.

As shown in FIGS. 1 and 2, the rotation of the weft insertion creel 30 is in a counterclockwise direction as viewed from above. The cam section 34 moves in synchronicity with the creel 30. The cam section 34 interacts with the needles 14 in a manner best understood if reference is now made to FIGS. 3 and 4.

Figure 3:
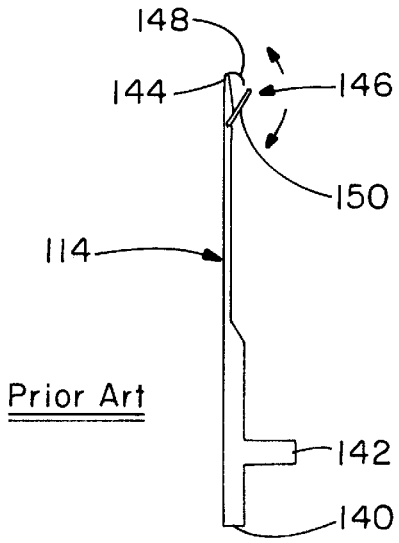
Prior Art FIG.-3
FIG. 3 shows an enlarged side view of a prior art latch needle as may be used in a knitting machine.

FIG. 3 shows a typical latch-type needle 114 as is known in the prior art. The needle 114 has a base 140 with a cam follower 142 near the base. At or near the top end 144, the needle 114 has a latch mechanism 146 comprising a hook 148 and a pivoting latch 150. This latch mechanism 146 is intended to capture and retain the stitch yarn (not shown in the Figure), with the latch 150 normally falling open due to gravity, but able to be closed by interaction with the cylinder wall or the like (not shown). Such interaction is occasioned by a vertical reciprocation of the needle caused by interaction of the cam follower 142 with a cam section 34 as shown and described above.

FIG. 4 shows a needle 14 of the type used in the present invention device. The needle 14 is a compound needle with first and second parts, 41, 43. The first part 41 has base 40 at the base end and an open yarn-engaging notch 52 at the other end. The second part 43 has a cam follower 42 near its base and a sheath member 54 having a top end 56, the sheath member slidingly fitted in a channel 45 of the first part. As cam follower 42 is moved relative to base 40, the second part 43 slides within the channel 45, allowing the sheath member 54 to selectively open or close an opening in the notch 52. As the needle 14 moves upwardly through interaction of the base 40 and cam follower 42 with the cam section 34 (not shown in the figure), notch 52 rises above the top 56 of sheath member 54, at which point the stitch yarn may be captured in the notch. As the cam section 34 rotates relative to the cam follower and allows the needle 14 to move downwardly, the stitch yarn is retained by the needle and may be manipulated until the needle again rises relative to the sheath member 54, exposing the notch 52 and permitting release of the stitch yarn.

Keeping in mind that a plurality of warp fibers 16 are also being brought into the insertion point 28 at the same time as the weft fiber 24 and the stitch yarn 26, one of skill in this art will immediately understand that the action of the cam section 34 and the relative rotation of the rotating creel 30 and the feed shaft will result in a matrix of warp and weft fibers, the matrix being held in place by the stitch yarn.

In some embodiments of the invention, and as shown in FIG. 5, a heat source 60 may be provided toward the bottom end of the device 10 to heat the tubular knitted product 18 as it is being drawn off of the device 10. If the stitch yarn 26 is a thermoplastic polymeric material, such a heat source 60 will bind the stitch yarn to itself at intersecting nodes formed by the needle action.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A device for knitting together a tubular structure of continuous fibers with a stitch yarn, comprising:

a cylinder having a plurality of axially oriented holes equally spaced about a circumference of the cylinder;

a plurality of needles, corresponding in number to the plurality of holes, each said needle having a latch mechanism at an end thereof and a base at the other end thereof, each needle inserted base end first into one of the holes, an interstitial space being defined between each pair of adjacent needles, a means for introducing a plurality of a first set of the continuous fibers to the cylinder effectively radially thereto, with one said first continuous fiber corresponding to each said interstitial space between the needles;

a means for introducing at least one second continuous fiber to the cylinder effectively tangentially thereto at an insertion point;

a means for introducing the stitch yarn to the latch mechanism of one of the needles on the cylinder adjacent the insertion point for each said at least one second continuous fiber;

a cam section interacting with the needles to sequentially raise and lower the base ends thereof; and a means for rotating the cam section, the introducing means for the at least one second continuous fiber, and the introducing means for the stitch yarn in a stepwise sequential manner around the cylinder, to knit the stitch yarn around the first and second continuous fibers, forming the knitted tubular structure.

2. The device of claim 1 wherein the means for introducing the first continuous fibers comprises a ring with a plurality of holes corresponding to the number of the plurality of first continuous fibers, such that the ring is concentric with the cylinder, although spaced axially away from and radially outward from the cylinder and each hole directs one of the first continuous fibers to one of the interstitial spaces.

3. The device of claim 1, further comprising a means for drawing the knitted tubular structure axially away from the cylinder.

4. The device of claim 1 wherein each of the plurality of needles is a compound needle having first and second parts;

the first part comprising a base at a first end and an open notch at a second end, a channel running axially through a portion therebetween;

the second part comprising a cam follower at a base end thereof and a sheath member with a top end;

wherein the sheath member is slidingly fitted in the channel so that movement of the cam follower relative to the base causes the second part to slide within the channel, allowing the top end of the sheath member to selectively open or close an opening in the notch.

5. The device of claim 1, wherein the stitch yarn is thermally fusible and the device further comprises a means for heating the knitted tubular structure as it is drawn away from the cylinder to a temperature sufficiently high to fuse the stitch yarn to itself.

6. A method for forming a knitted tubular structure of continuous fibers, comprising the steps of:

introducing a plurality of a first set of the continuous fibers effectively radially to a cylinder having a plurality plus one of latch needles disposed in incremental spacing about a circumference thereof, the plurality of first continuous fibers introduced so that one said first continuous fiber passes through an interstitial space defined by a pair of adjacent said latch needles;

introducing at least one second continuous fiber to the cylinder effectively tangentially thereto at an insertion point;

introducing a stitch yarn to a latch mechanism of one of the latch needles on the cylinder adjacent the insertion point for each said at least one second continuous fiber; and manipulating the latch needles and stitch yam adjacent the insertion point to knit the stitch yarn about the first and second continuous fibers to form the tubular structure.

7. The method of claim 6 wherein the step of manipulating the latch needles and stitch yarn is achieved by rotating the insertion point for each said at least one second continuous fibers in a stepwise sequential manner around the circumference of the cylinder.

8. The method of claim 6, further comprising the step of drawing the knitted tubular structure away from the cylinder.

9. The method of claim 8, further comprising the step of using a thermally fusible stitch yarn and heating the knitted tubular structure as it is drawn away from the cylinder to a temperature sufficiently high to fuse the stitch yarn to itself.

* * * * *